US005927434A

United States Patent [19]

Wu

[11] Patent Number: 5,927,434

[45] Date of Patent: Jul. 27, 1999

[54] EXTENSIBLE LADDER

[76] Inventor: Sheng-Fu Wu, No. 286, Meng Tzu Road, Kaohsiung, Taiwan

[21] Appl. No.: 09/210,881

[22] Filed: Dec. 15, 1998

[51] Int. Cl.[6] ..... E06C 9/00

[52] U.S. Cl. ..... 182/95

[58] Field of Search ..... 182/95, 93, 194, 182/196

[56] References Cited

U.S. PATENT DOCUMENTS 209,916 11/1878 Ochsner ..... 182/95

277,124 5/1883 Ferris ..... 182/95

*Primary Examiner*—Alvin Chin-Shue

*Attorney, Agent, or Firm*—Rosenberg, Klein & Bilker

[57] ABSTRACT

An extensible ladder includes an upper frame, an up and down transmitting unit and a first and a second extensible frame. The first and the second extensible frame each have a plurality of pairs of crisscrossing rods pivotally connected with each other. Plural ladder steps and connecting rods are pivotally connected between the first and the second extensible frame. The connecting rods are pivotally connected to guide blocks, which have a vertical threaded hole for each of two threaded rods of the up and down transmitting unit to fit in and engage. Then each threaded rod has a clockwise threaded portion and counterclockwise threaded portion engaging the vertical threaded holes of the guide blocks. When an active rod with two worm sections is rotated by two worm gears combined with splines with an upper spline shaft portion of the two threaded rods, the active rod rotates the threaded rods, forcing the two extensible frames to extend down or shrink up.

5 Claims, 9 Drawing Sheets

EXTENSIBLE LADDER

BACKGROUND OF THE INVENTION

This invention relates to an extensible ladder, particularly to one easily extensible to become small dimensions when collapsed.

Conventional ladders are widely used for work or set at permanent site for fleeing one's life. They have definite length and dimensions and comparatively occupy large space. They have the following disadvantages in putting away.

1. As a ladder has a certain length, it is not easy for users to find a place for storing or putting it away.

2. If a ladder is set at a site and leaned on a wall, it may hurt people when falling down by accident; if it remains outdoors for use, it may be dangerous in case a theft breaks into a house.

3. It is very inconvenient to be carried because it is longer than the length of a vehicle and may cause danger in carrying.

SUMMARY OF THE INVENTION

This invention has been devised to offer an extensible ladder, mainly including a first and a second extensible frame of the same structure extended down or shrunk up by an up and down transmitting unit, and an upper frame fixed on a wall at a high location. The first and the second extensible frame respectively have a plurality of pairs of crisscrossing rods pivotally connected to each other to extend down for use or to shrink up for collapsing. Plural steps and connecting rods are pivotally connected between the first and the second extensible frame for climbing. The connecting rods are pivotally connected by guide blocks, which have vertical threaded holes for two threaded rods of the up and down transmitting unit to fit and engage threadably. Each vertical threaded rod has a clockwise threaded portion and a counterclockwise threaded portion for the guide blocks to engage. When two worm sections of a horizontal active rod of the up and down transmitting unit is rotated by two worm gears provided on an upper portion of the two threaded rods, the threaded rods are rotated by engagement of the guide blocks with the threaded rods, forcing the crisscrossing rods unit to extend down for use or shrink up for collapsing.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
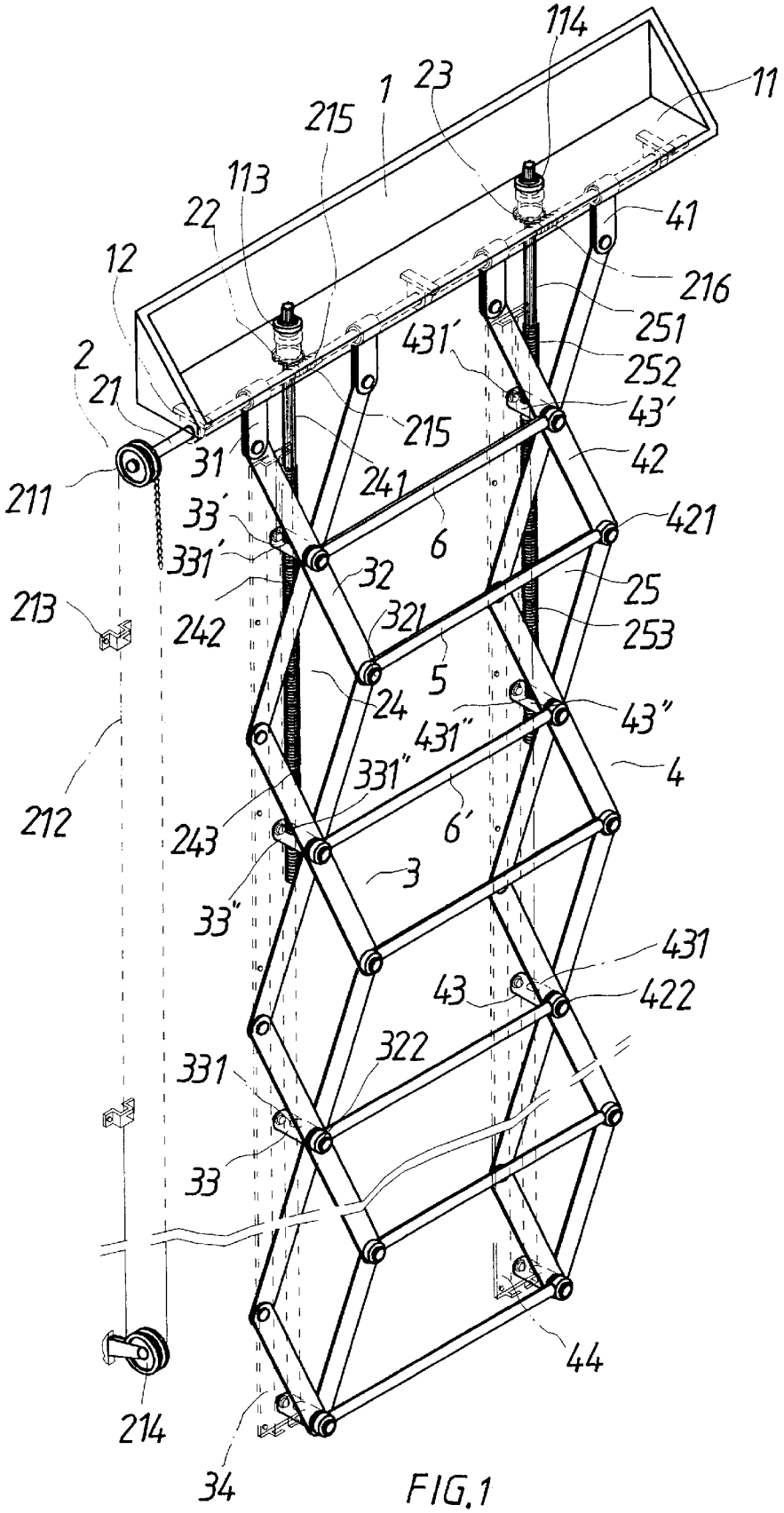
FIG. 1 is a perspective view of an extensible ladder of the present invention.

A preferred embodiment of an extensible ladder of the present invention, as shown in FIG. 1, includes an upper horizontal frame 1, an up and down transmitting unit 2, a first extensible frame 3 and a second extensible frame 4 as main components combined together.

Figure 2:
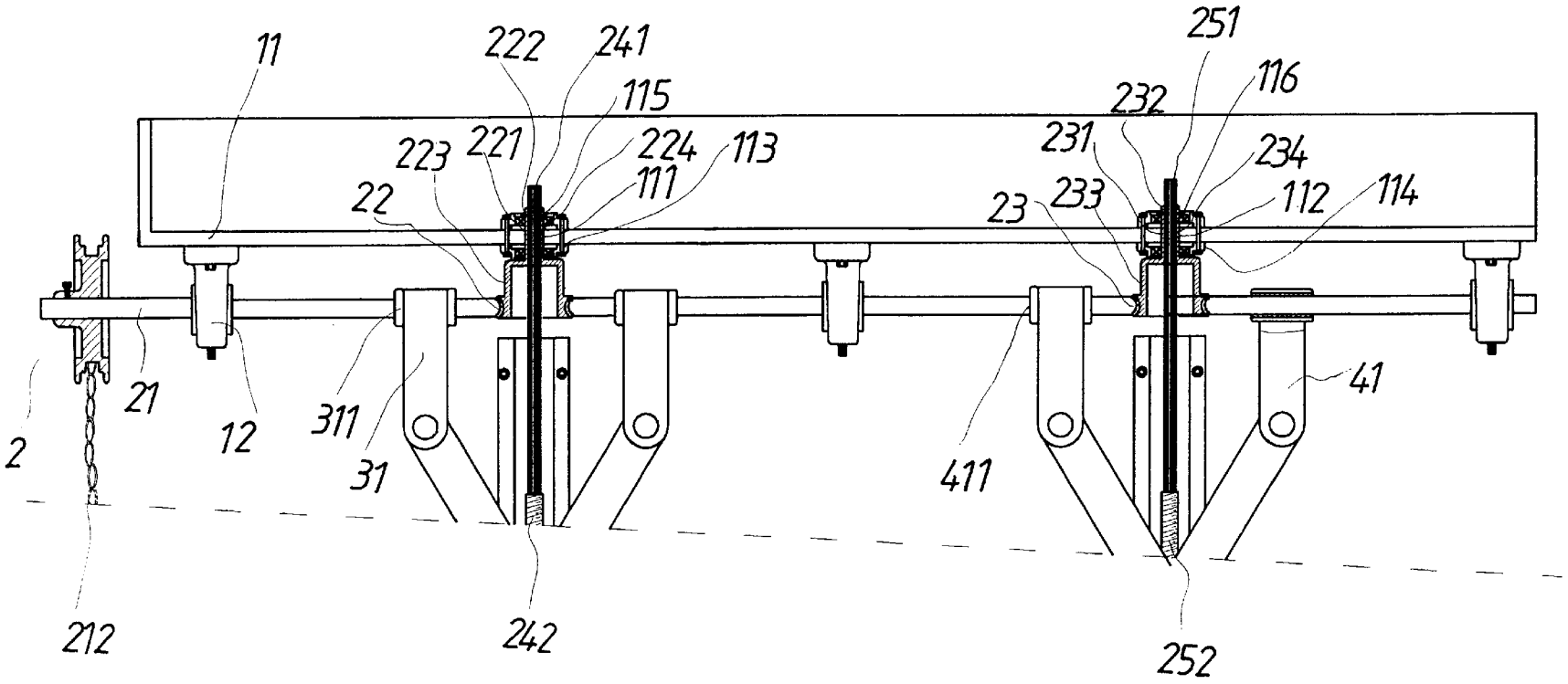
FIG. 2 is a cross-sectional view of an up and down transmitting unit of the present invention.

The upper horizontal frame 1, as shown in FIG. 2, is L-shaped, to be fixed firmly on a wall, having bearing holes 111,112 respectively at two sides of the horizontal portion 11, connecting bearings 113,114 respectively fixed on and under the horizontal portion 11 at each bearing hole 111, 112. Each connecting bearing 113,114 respectively has a shaft hole 115, 116 each facing just the hole 111,112. A plurality of bearing bases 12 are fixed under the horizontal portion 11 space apart, for an active rod 21 of the up and down transmitting unit 2 to pass through horizontally.

The up and down transmitting unit 2 consists of the active rod 21, two worm gears 22,23 and two threaded rods 24,25.

The active rod 21 is horizontally located below the upper horizontal frame 1, having a first chain wheel 211 fixed on a first end for a chain 212 to extend around. The chain 212 passes through protective covers 213 fixed on a wall and it extends around a second chain wheel 214 fixed at a lower position near the ground. When the chain 212 is manually moved up and down, the active rod 21 is rotated, and meanwhile, two worm sections 215,216 of the active rod 21 engaging the worm gears 22,23 rotate the worm gears 22, 23.

Figure 3:
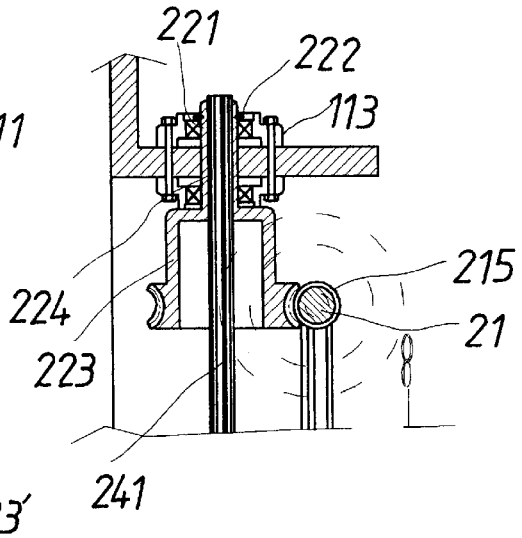
FIG. 3 is a partial cross-sectional view of the extensible ladder of the present invention, showing worm gear of the up and down transmitting unit combined with an active rod.
Figure 4:
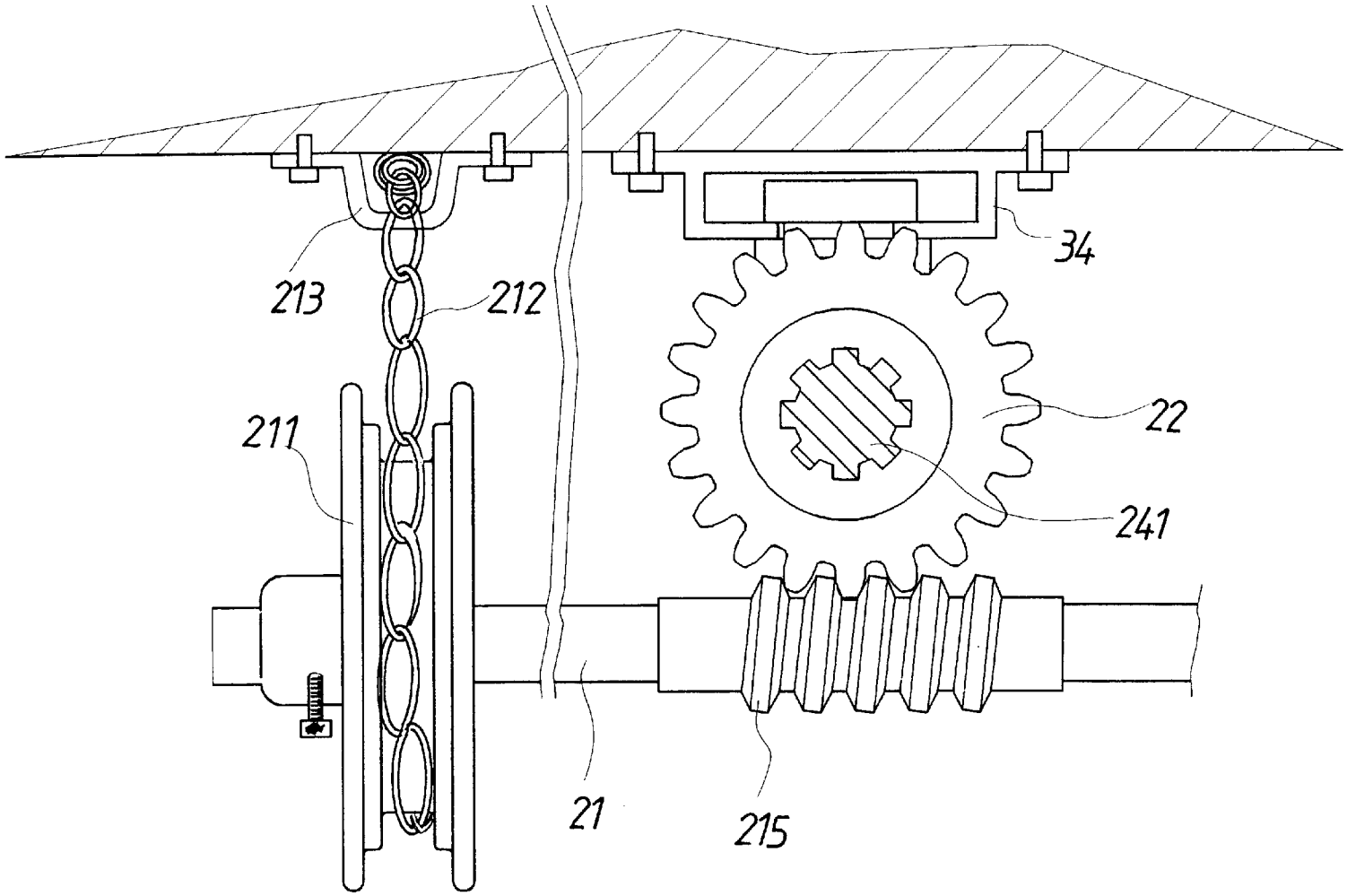
FIG. 4 is another partial cross-sectional view of the extensible ladder of the present invention, showing the worm gear of the up and down transmitting unit combined with the active rod.

The worm gears 22,23 respectively have slide portions 221, 231 formed on the worm gears 22, 23 fitting in the shaft holes 115, 116 of the connecting bearings 113, 114, as shown in FIG. 3, and locked in place with lock washers 222,223, combining the worm gears 22,23 on the connecting bearings 113,114 without loosening off. Further, the worm gears 22,23 may further respectively have cylindrical portions 223,233 under the slide portions 221,231, depending on the length of hangers 31,41 of the first and the second extensible frames 3 and 4. In case that the hangers 31, 41 are comparatively long, the cylindrical portions 223, 233 may not be needed. Further, the slide portions 221,231 are respectively provided with splines 224,234 for upper spline shaft portions 241,251 of the threaded rods 24,25 to fit in and engage with each other. Further, the threaded rods 24,25 respectively have clockwise threaded portions 242, 252 and counterclockwise threaded portions abutting under the clockwise threaded portions 242, 252 engaging with guide blocks 33', 33", 43', 43" of the two connecting rods 6 located at the uppermost ends of the first and the second extensible frames 3 and 4.

The first and the second extensible frames 3,4 have the same structure, respectively having the two hangers 31,41 formed integral with a slide sleeves 311,411 at an upper end, with the slide sleeves 311,411 fitting around the active rod 21 and spaced apart properly at two sides. Then the lower ends of the hangers 31,34 are pivotally connected to crisscrossing connecting rods units 32,42 having the same length. Between pivotal connecting points 321,421 of the crisscrossing connecting rods units 32,42 are connected ladder steps 5, and between intermediate pivotal connecting points 322,422 of the crisscrossing connecting rods units 32,42 are connected connecting rods 6 by guide blocks 33, 43.

Figure 5:
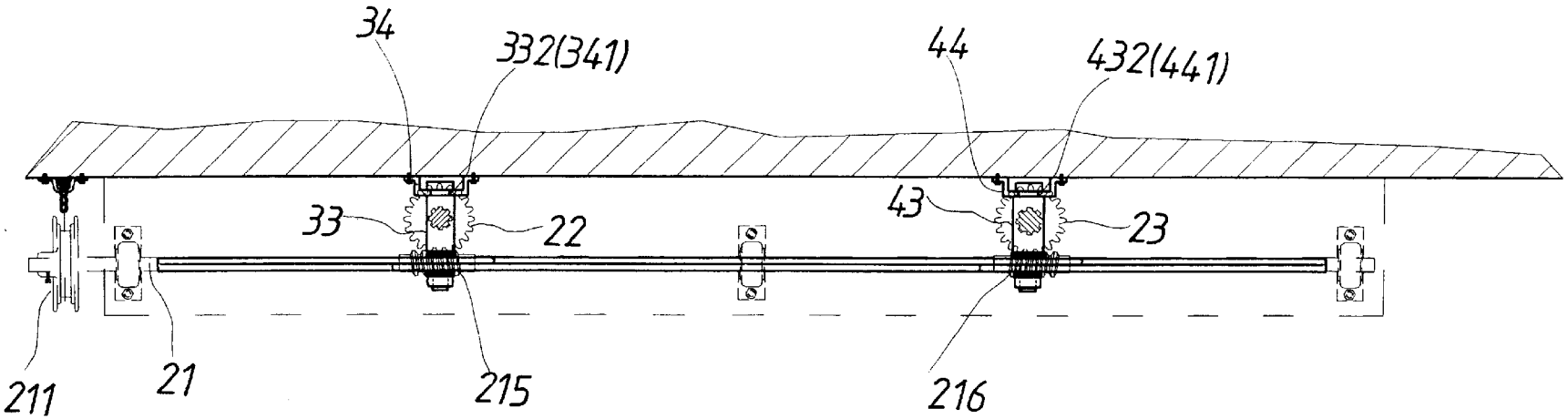
FIG. 5 is an upper view of the up and down transmitting unit of the present invention.
Figure 6:
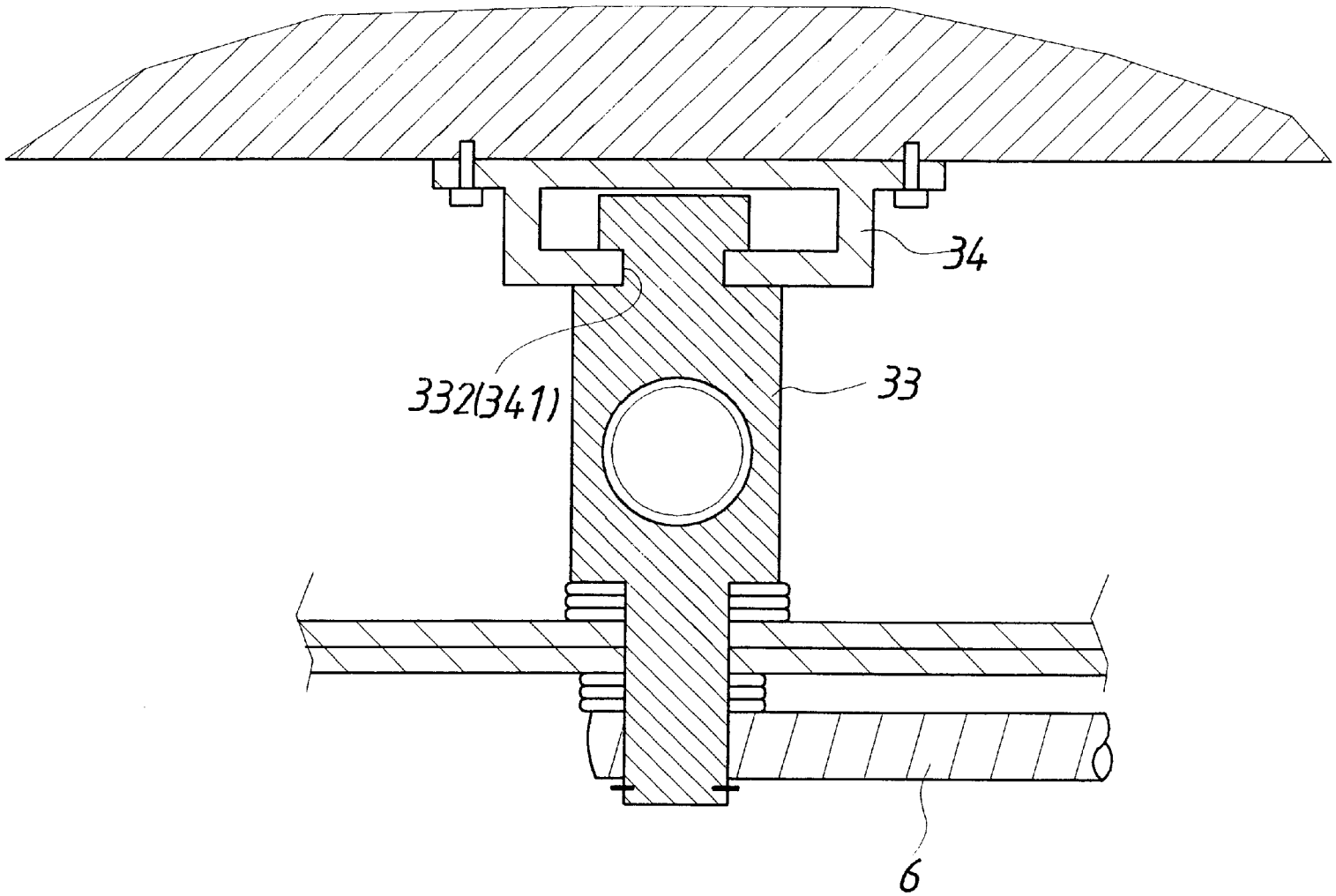
FIG. 6 is another cross-sectional view of the extensible ladder of the present invention, showing a guide block combined with a guide strip.

All the guide blocks 33,43 except the uppermost ones 33', 33", 43', 43" are provided with lateral holes 331, 431. The uppermost guide blocks 33', 33", 43', 43" are provided with lateral threaded holes 331', 331", 431', 431" to engage with the clockwise threaded portion 242,243 and the counterclockwise threaded portion 252, 253 of the threaded rods 24,25. Further, the guide blocks 33, 43 have one ends provided with annular guide grooves 332, 342, as shown in FIGS. 5 and 6, for guide grooves 341, 441 of the guide strips 34, 44 fixed on the wall to engage so that the guide blocks 33, 43 may move up and down along the guide strips 34, 44 without biasing to any side, if rotated by the threaded rods 24, 25.

In assembling, referring to FIG. 1, firstly the upper frame 1 is fixed on a wall at a needed height. Then the first and the second extensible frames 3 and 4 are hung on the active rod 21, with the slide sleeves 311, 411 of the hangers 31, 41 made to fit around the active rod. Next, the crisscrossing connecting units 32, 42 are pivotally connected to the lower ends of the hangers 31,41. Then the active rod 21 is combined with the bearing bases 12 under the upper frame 1, and the two threaded rods 24, 25 are made to pass through the worm gears 22, 23 engaging with the worm sections 215, 216 of the active rod 21, with the upper threaded portions 241, 251 engaging the threaded holes 224, 234 of the threaded rods 24, 25. Then the clockwise threads 242, 243, the counterclockwise threads 252, 253 are made to engage the guide threaded holes 331', 331", 431', 431" of the guide blocks 33', 33", 43', 43" pivotally connected to the connecting rods 6, 6', with the guide grooves 332, 432 engaging the guide strips 34, 44. Thus, the assemblage of the extensible ladder of the present invention is finished.

Figure 7:
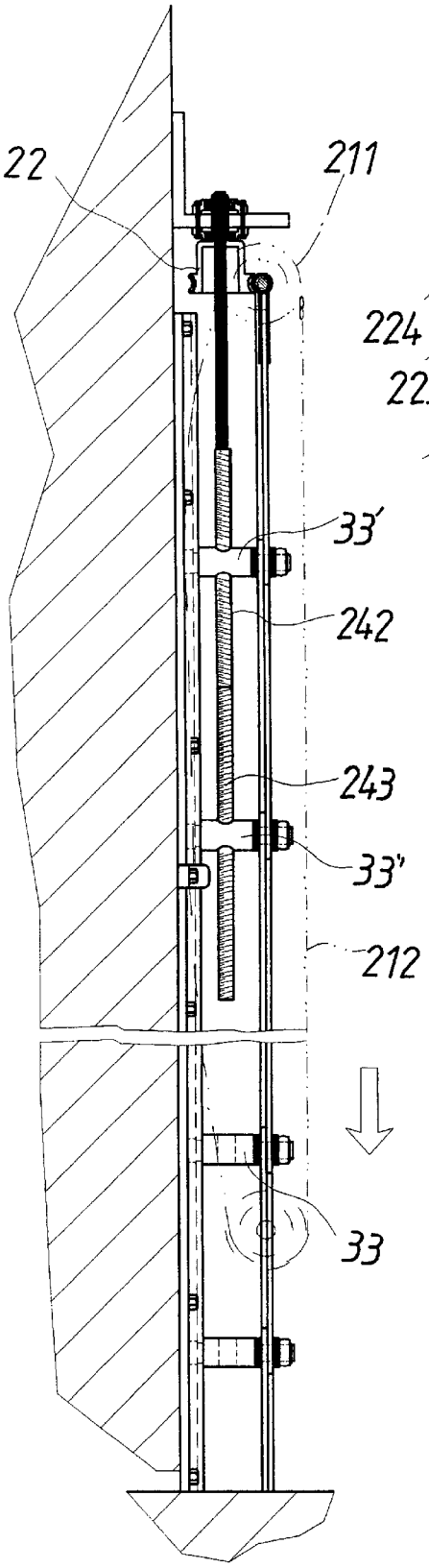
FIG. 7 is a side view of the extensible ladder being in the extended position of the present invention.
Figure 8:
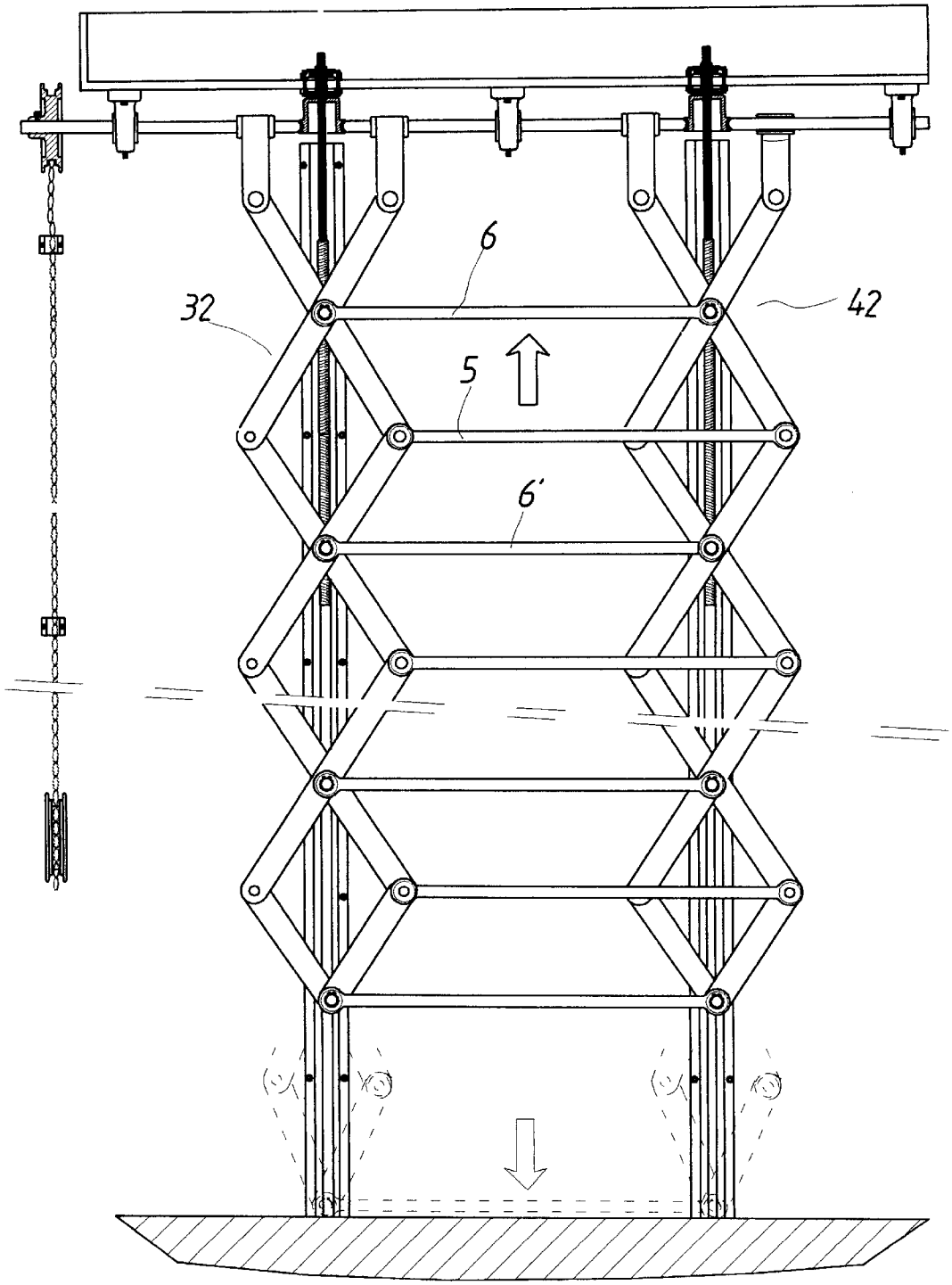
FIG. 8 is a front view of the extensible ladder being in the extended position of the present invention.
Figure 9:
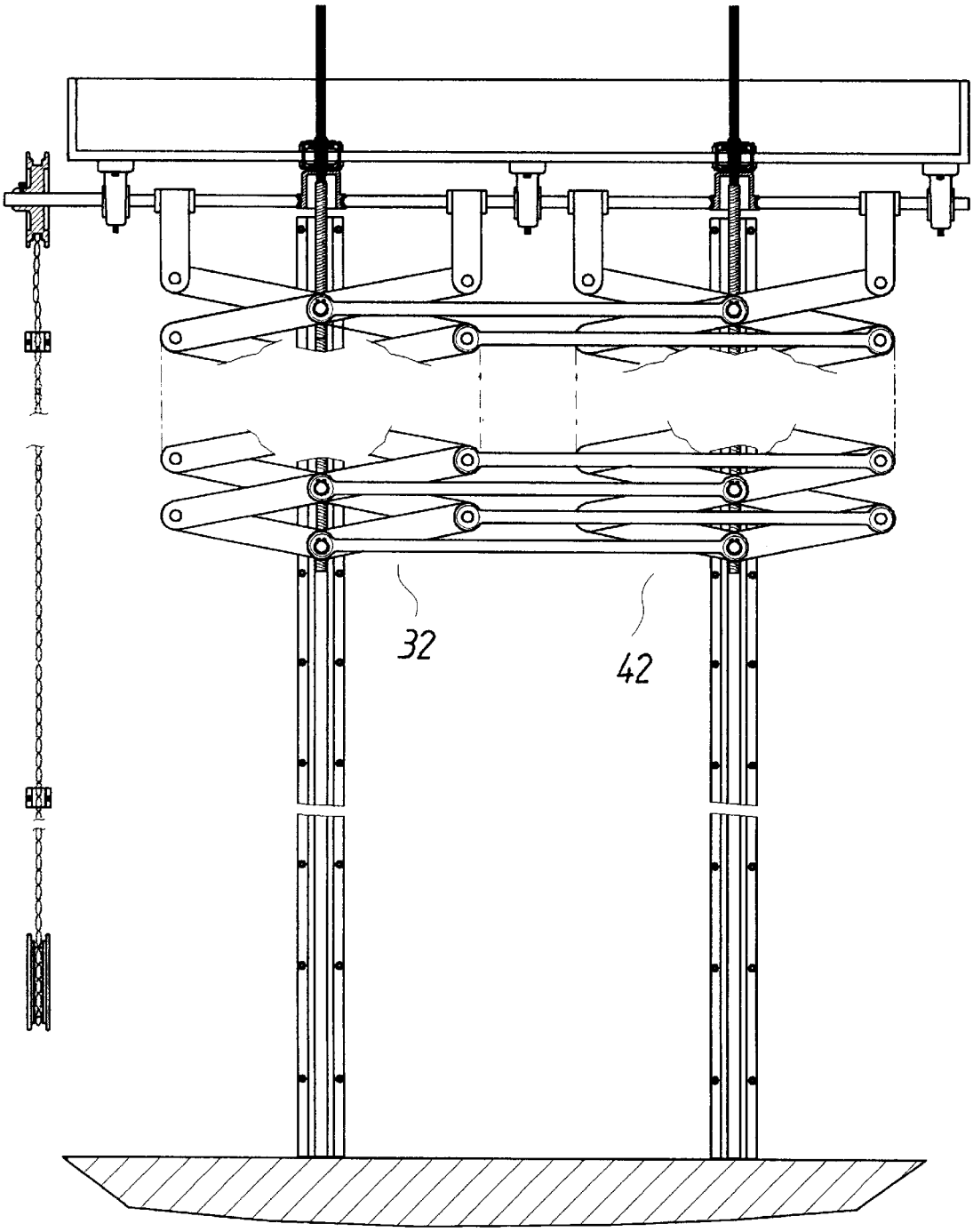
FIG. 9 is a front view of the extensible ladder being in the collapsed position of the present invention.

In using, referring to FIG. 7, the chain 212 is manually pulled to rotate the chain wheel 211 and the active rod 21 together, with the worm sections 215, 216 rotate the worm gears 22, 23. Then the worm gears 22, 23 rotate the two threaded rods 24, 25 with the threaded holes 224, 234 of the upper threaded portions 221, 231, forcing the clockwise threads 242, 243 and the counterclockwise threads 252, 253 engaging the guide blocks 33', 33", 43', 43" to move up or down so that the connecting rods 6, 6' and the ladder steps 5 may move nearer to or farther from one another, and the upper threaded portions 241, 251 may slide in the threaded holes 224, 234 up or down. When the connecting rods 6, 6' move farther from each other, the crisscrossing connecting rods units 32, 42 extend gradually downward, as shown in FIG. 8 and to the lowest position wherein a user may put the foot on the lowest step 5 and the lowest connecting rod 6 for climbing. When the connecting rods 6, 6' move nearer to each other, the crisscrossing connecting rod units 32, 42 are moved up gradually to the highest position (the collapsed position), as shown in FIG. 9, wherein the lower ends of the threaded rods 24, 25 screw with the lateral threaded holes 331 of the guide blocks 33, 43.

Figure 10:
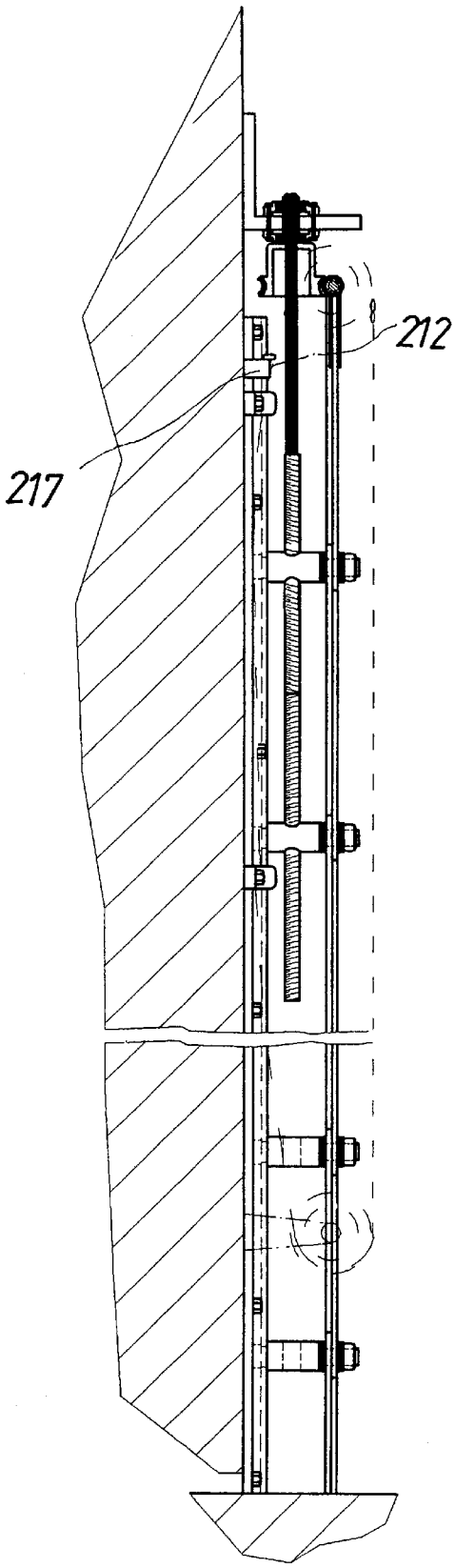
FIG. 10 is a side view of the extensible ladder additionally provided with a micro switch of the present invention.

In addition, as shown in FIG. 10, a micro switch 217 may be provided at the entrance of the highest protective cover 213, electrically connected with an alarm system, and contacting the chain 212. Then when the chain 212 is manually moved up or down, the micro switch 217 may activate the alarm system to give out an alarm to all attention that the ladder is in use to persons around and the owner either in legal use or illegal use.

The invention has the following advantages, as seen in the aforesaid description.

1. It is easily extended down for use or shrunk up for collapsing to the shortest length so as not to occupy a large space.

2. Though it is fixed outdoors, it can be collapsed to a high position, with the micro switch connected to the alarm system as a safe measure, preventing it from illegally used by thieves.

3. It can be used as an emergency ladder for escaping out of a building by handling the chain.

4. It can be collapsed to 1/15–1/20 of the extended length so that it is very convenient for transporting.

What is claimed is:

1. A extensible ladder comprising:

an upper frame fixed firmly on a wall at a height, and L-shaped to have a horizontal portion and a vertical portion, a bearing hole provided in two sides of said horizontal portion, a connecting bearing fixed on and under said horizontal portion at each said bearing hole, each said connecting bearing having a shaft hole and spaced apart under said horizontal portion for engaging a horizontal active rod of an up and down transmitting unit;

said up and down transmitting unit comprising said horizontal active rod, two worm gears and two threaded rods, said horizontal active rod located below said upper frame, a chain wheel at a first end of said active rod, a chain provided to extend around said chain wheel for rotating said chain wheel together with said horizontal active rod when pulled, said active rod having two worm sections spaced apart to engage respectively with said two worm gears, each said worm gear having a slide section formed to extend into said shaft hole of each said connecting bearing fixed on said upper frame, said slide section having splines for an upper spline shaft portion of each said threaded rods to fit in said slide section, each said threaded rod having a clockwise threaded portion and a counterclockwise threaded portion below to said clockwise threaded portion, said clockwise threaded portion and said counterclockwise threaded portion respectively engaging with two guide blocks located at the uppermost end of a first and a second extensible frame;

said first and said second extensible frame being identical, and each having a crisscrossing rod unit comprising a plurality of pairs of rods crisscrossing each other and pivotally connected to one another, a connecting rod pivotally connected to a respective guide block of said two guide blocks between an intermediate point of each said pair of crisscrossing rods of said first extensible frame and that of said second extensible frame, a ladder step pivotally connected between respective ends of each said pair of crisscrossing rods of said first extensible frame and that of said second extensible frame, said two uppermost guide blocks respectively having a vertical threaded hole for said two threaded rods to fit in for said clockwise threaded protion and said counterclockwise threaded portion to engage with, said transmitting unit comprising other guide blocks having a through hole in line with said threaded holes of said two uppermost guide blocks; and, said chain of said up and down transmitting unit manually pulled to rotate said chain wheel and said active rod therewith, said worm gears being rotated by said active rod to rotate said vertical threaded rods so that said clockwise threaded portion and said counterclockwise threaded portion may rotate to move up or down said guide blocks at the uppermost ends of said first and said second extensible frame, said crisscrossing rods units accordingly being retracted or extended.

2. The extensible ladder as claimed in claim 1, wherein another chain wheel is further provided at a lower position near the ground for said chain to extend around.

3. The extensible ladder as claimed in claim 1, wherein said chain of said up and down transmitting unit passes through protective covers fixed on the wall.

4. The extensible ladder as claimed in claim 3, wherein a micro switch is further provided at an entrance of one of said protective covers, for electrically connecting to an alarm system and to said chain.

5. The extensible ladder as claimed in claim 1, wherein each said guide block is provided with grooves for projections of a guide strip to engage and keep said first and said second extensible frames stabilized.

* * * * *